United States Patent [19]

Chamberlin

[11] Patent Number: 4,809,727

[45] Date of Patent: Mar. 7, 1989

[54] THERMALLY-ACTIVATED DRIP VALVE

[76] Inventor: John M. Chamberlin, 2800 Dunsinane Rd., Pensacola, Fla. 32503

[21] Appl. No.: 198,014

[22] Filed: May 24, 1988

[51] Int. Cl.[4] ..... E03B 7/12; F16L 55/00

[52] U.S. Cl. ..... 137/62; 137/79; 237/80; 251/368

[58] Field of Search ..... 137/59, 60, 61, 62, 137/79; 138/27, 28, 32; 236/100; 237/80; 60/527; 251/368

[56] References Cited

U.S. PATENT DOCUMENTS

| | | | |
|---|---|---|---|
| 330,664 | 11/1885 | Bacon et al. | 137/62 |
| 360,139 | 3/1887 | Browne | 137/61 |
| 3,320,965 | 5/1967 | Morgan | 137/62 |
| 3,369,556 | 2/1968 | Allderdice | 137/79 |
| 3,446,226 | 5/1969 | Canterbury | 137/62 |
| 4,205,698 | 6/1980 | Hucks | 137/62 |
| 4,437,481 | 3/1984 | Chamberlin et al. | 137/62 |
| 4,456,024 | 6/1984 | Roberts | 137/62 |
| 4,484,594 | 11/1984 | Alderman | 137/62 |
| 4,522,219 | 6/1985 | Ohkata | 137/62 |

*Primary Examiner*—George L. Walton
*Attorney, Agent, or Firm*—John E. Benoit

[57] ABSTRACT

A self-actuating drip for attachment to a standard faucet for the prevention of freezing of such exposed faucets and water pipes leading to the faucets. An elongated housing includes a collar for securing one end of the housing about the open end of the faucet. A tube extends from the collar and mates with a closure at its distal end. A stem extends within the tube from the closure and terminates in a tip which mates with an exit port extending through said collar. A compressible seal adjacent the stem closes the exit port between the collar and the interior of the tube when the ambient temperature is above freezing. The tube and stem are of different materials, one being plastic and the other being metal. Since the plastic and metal have different coefficients of expansion, a reduction of ambient temperature below freezing releases the seal and permits water to flow from the faucet through the tube. Once water enters the valve and flows down the internal surface of the tube, valve flow control becomes self-regulating so that the water flow is dependent on the ambient temperature and the temperature of the inlet water which combine to balance heat loss to the ambient atmosphere from the faucet, valve and line. The tube has release ports for passage of water therethrough.

9 Claims, 2 Drawing Sheets

THERMALLY-ACTIVATED DRIP VALVE

The present invention relates to a temperature-activated valve and more particularly to a valve which can be attached to an existing external faucet so as to cause the faucet, and the water line feeding the faucet, to continuously drip water and, thus, keep the line and the faucet from freezing when the outside temperature drops below freezing.

The problem of installed plumbing, particularly in the southern part of the United States, often includes outside water faucets which do not have adequate protection from an occasional severe drop in temperature to below freezing. The problem is so common that in many cities of the south the television weatherman will advise, "Drip your faucets tonight and until the freeze is over." If not dripped, the water in the faucet freezes, the forming ice expands, and the faucet may rupture. When the temperature rises to above freezing, the water runs from the ruptured faucet, sometimes being undetected for long periods. In more severe cases the water in the line feeding the faucet may also freeze and rupture that line. Inasmuch as such lines are normally within the walls, floors, or ceilings of a structure, the resulting water flow can cause considerable damage beyond that of the necessity to replace the damaged faucet. Yet many people forget, are not home, or do not know how to drip a faucet.

Prior proposed devices describe a number of approaches toward solving this problem. Such solutions range from insulating the faucet (which generally only postpones the freezing) to devices which contract to open a bypass (U.S. Pat. No. 1,277,197 to Crandon), devices having a one-time release via pressure and temperature (U.S. Pat. No. 3,320,965 to D. L. Morgan), thermostatic wafers (U.S. Pat. No. 3,397,711 to Strange), and the use of thermally expanding or contracting fluids (U.S. Pat. No. 4,205,698 to Hucks and U.S. Pat. No. 3,446,226 to Canterbury). Some solutions utilize water freezing and expanding as the activating mechanism (U.S. Pat. No. 3,511,253 to Ljutove, U.S. Pat. No. 3,369,556 to Allderdice, U.S. Pat. No. 3,380,464 to Arterbury, and U.S. Pat. No. 4,437,481 to Chamberlin). Bacon, in U.S. Pat. No. 330,664, uses the differential expansion of two metals in contact with water and in combination with a water service pipe and a waste water pipe to provide a bypass to the waste water pipe.

An object of the present invention is to provide an entire whole valve for removable attachment to an external water faucet, which valve will automatically bleed, or drip, sufficient line water to prevent the faucet and adjacent line from freezing when the outside temperature drops below freezing.

A further object of the present invention is to provide a valve which will attain an increased flow or bleed of water as required by decreasing ambient temperature conditions to prevent freezing of water in the faucet.

A further object of the present invention is to provide a valve which requires no resetting after actuation.

A further object of the present invention is to provide a valve which, though temperature-sensitive, has resilient seals capable of opening with contraction and yet allows further compression beyond the initial setting.

A further object of the present invention is to provide a valve having vents which allow the ambient air to reach the temperature-sensitive members and allow the escape of released water.

A still further object of the present invention is to provide a valve which utilizes the differential linear coefficients of thermal expansion of a metal and of a plastic to activate the opening and closing of a valve seat but, when opened, water flow becomes self-regulating to balance heat loss to the atmosphere with latent heat input from the flowing water.

SUMMARY OF THE INVENTION

The present invention provides a self-actuating drip valve for attachment to a standard faucet for the prevention of freezing exposed water pipes. An elongated housing includes a collar for securing one end of the housing about the outer end of the faucet, with a tube extending from the collar which terminates in a closure such as a cap or plug. A stem extends from the closure through the tube and mates with an exit port extending through the collar. A compressible seal adjacent the stem closes the passageway between the collar and the interior of the tube when the ambient temperature is above freezing. The tube and stem are of different materials, one being plastic and the other being metal. Since the plastic and metal have different coefficients of expansion, a reduction of ambient temperature to a point near freezing releases the seal and permits water to flow. The tube includes release ports for passage of water outwardly from the tube. Once water flows, a self-regulation of flow occurs which balances heat loss of the valve to the atmosphere with latent heat input by the water.

DETAILED DESCRIPTION OF THE PREFERRED EMBODIMENTS

Figure 1:
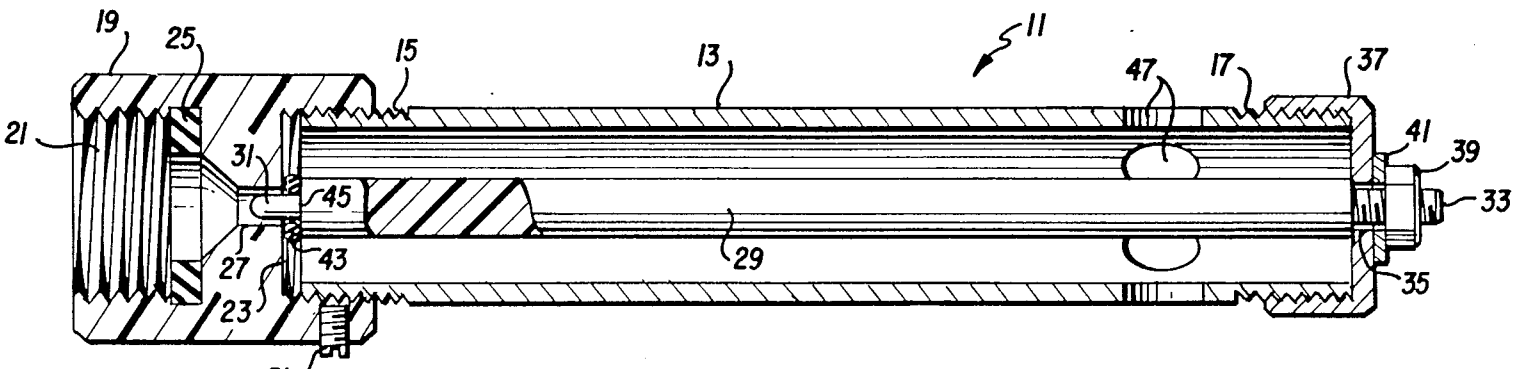
FIG. 1 is a cross-sectional view of one embodiment of the invention.
Figure 2:
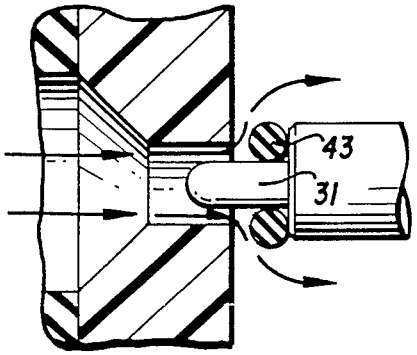
FIG. 2 is a partial cross-sectional view of the seal of FIG. 1.

Turning now to FIGS. 1 and 2, there is disclosed thermally-activated drip valve 11 comprising metal tube 13 having external threading 15 and 17 on either end thereof. Collar 19, which is of a plastic material, includes internally threaded boreholes 21 and 23 at either end thereof. Threaded borehole 21 is adapted to be attached to an outside faucet and may be provided with a standard washer 25.

Threads 15 of metal tube 13 mate with the internal threads 23 in collar 19. External threads 17 at the other end of tube 13 accept a closure, such as cap 37, which has internal threads which mate with threads 17. Stem 29, which is of a plastic material, extends from cap 37 through the length of tube 13 and terminates in tip 31. Tip 31 enters into exit port 27 in collar 19. The other end of stem 29 terminates in an externally threaded reduced section 33 which passes through borehole 35 and cap 37. Stem 29 is secured to cap 37 by means of nut 39 and lock washer 41.

Compressible O-ring 43 passes about tip 31 so as to provide a seal as the relative position of stem 29 and collar 19 are properly adjusted. When the adjustment is properly made, set screw 51 may be used to secure tube 13 in such a position.

The operation of the valve is as follows: The valve is assembled as shown, with a predetermined compression of O-ring 43, and collar 19 is screwed onto the standard hose threads of a faucet (not shown) creating a seal using washer 25. The valve must be between 0° and 80° from vertical, downward. The faucet is then turned on and the combination of faucet and valve are prepared for winter's "hard freezes." As the outside temperature drops, stem 29, which is of a plastic material, shrinks more than does tube 13, which is of a metallic material. This causes the seal created at O-ring 43 to lessen and then open, allowing water to escape as indicated by the arrow in FIG. 2. With a proper predetermined compression of O-ring 43, this water flow will begin at a temperature of between 33° F. and about 35° F.

Once water flow begins, the latent heat of the water above the valve's opening set-point temperature enters into the valve's function and there commences a second stage of control. The released water runs down the internals of the valve and exits at exit holes 47, usually in drops. The water is above freezing and transfers heat to tube 13. By some complex and unexplained heat transfers within the valve itself, and because of the two materials of construction having differential coefficients of thermal expansion, the valve self-regulates water flow so as to balance the heat lost to the atmosphere by the faucet and the valve with the available latent heat from the water. The valve controls flow to just that required considering the outside temperature and the temperature of the inlet water. Typical operation of the valve in this second stage of control results in a flow measurable by several drops per second. One drop per second is about one pint per hour. One pint is about one pound.

Figure 4:
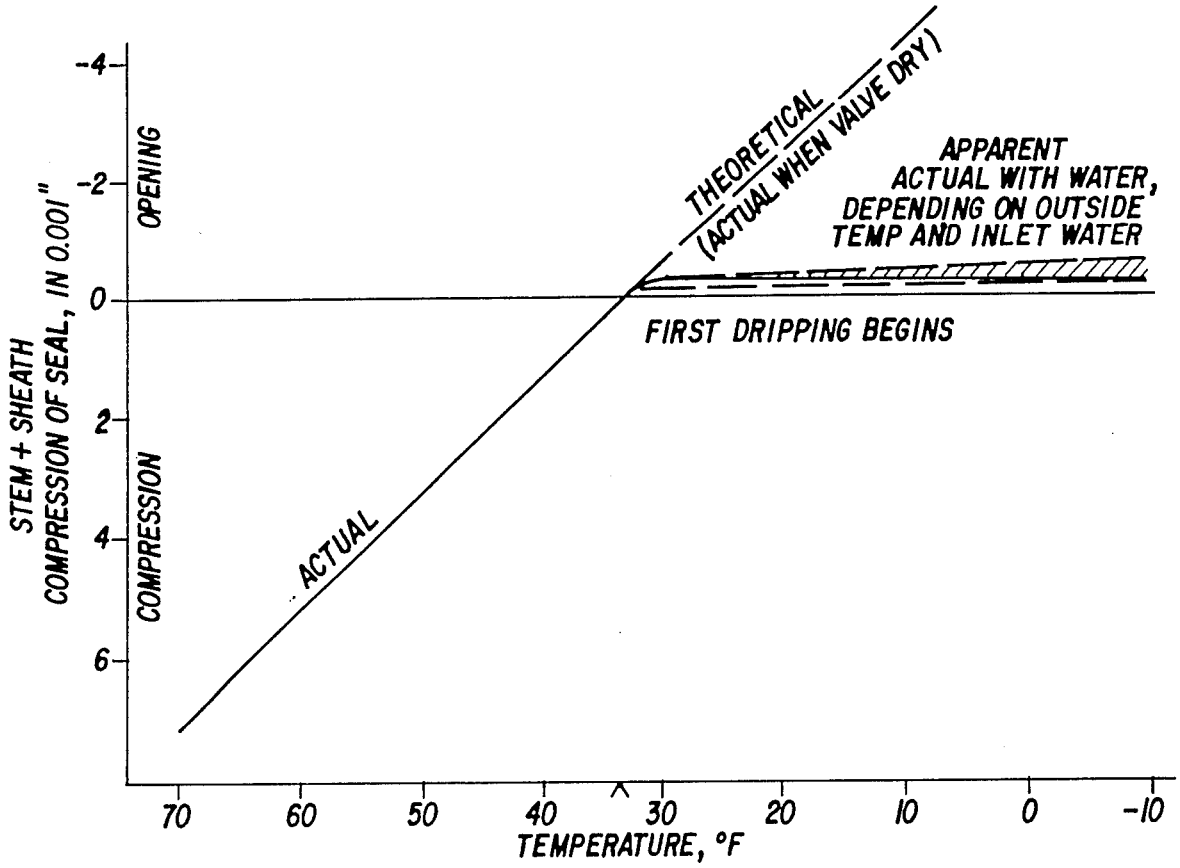
FIG. 4 is a graphic illustration of the operation of the valve.

FIG. 4 shows the compression and the opening of the seal which would result from straight linear thermal expansion and shrinkage of a five-inch plastic stem 29 and a metallic tube 13. The theoretical opening is shown in a dotted line. Such opening actually occurs when the valve is dry. The test valve followed the expected line from, say, 75° F. to the set point of 34° F. Then, at temperatures below that, when water flows and the second stage of control is in effect, further opening and/or closing of the valve is very minute. Flow varies from about one to about three drops per second, or pounds per hour. The variation is shown in dotted lines with the average shown as a solid line. Calculations indicate that the valve, under these conditions, opens no further than another one-half thousandth of an inch, even at 0° F., yet flows just suffucient water to prevent freezing.

In one typical test, with inlet water temperature at 68° F., the valve flowed 0.7 pounds per hour at an ambient temperature of 20° F. The exit water temperature was 40° F. At 0° F. ambient the flow was one pound per hour and exit water temperature was 35° F. The next day an identical test was run except that inlet water temperature was 45° F. Water flowed 1.8 pounds per hour at 20° F. ambient with an exit temperature of 34° F. and three pounds per hour with an exit temperature of 34° at 0° F. ambient. In both cases the flow balanced 20 BTU/hr. at 20° F. and 33 BTU/hr. at 0° F. The variation of flow with inlet water temperature to balance heat loss assures that the valve will work at minimum flow whether the water is from a warm house or a cold garage.

The literature gives coefficients of linear thermal expansion of aluminum as $12.4\times10^{-6}$ inches per inch per degree F. It lists steel at 7.0 to 10.0 on the same scale, and brass at 10.0. Plastics are shown with coefficients, on the same scale, from 38.0 to 100.0, or about four to ten times that of metals. The test valves of this invention used aluminum and stainless steel for the tube 13, and ABS and polyacetal as the stems 29, all of which combinations worked well. The ABS and the polyacetal stems had measured coefficients of 50.0.

The presetting of a temperature when the valve will first open to begin dripping is very important. If set too low, water in the faucet or valve may freeze and not flow even when the valve opens. If set too high the valve will run water unnecessarily, even above freezing. Dripping should begin in a range of 33° F. to 35° F. As commercially available O-rings have tolerances of only +0.003" or −0.003" in thickness and the setpoint adjustment is a matter of less than 0.001", then each assembled valve should be individually set and locked in place with set screw 51. Once a valve is set, the consumer merely needs to screw the valve to the faucet and turn the faucet on. An opening set at 34° F., with the materials being aluminum for tube 13 and ABS for stem 29 means that at 70° F. the seal at O-ring 43 will be compressed about 7 thousandths of an inch (mils). Thus, the seal must be elastically compressible.

Figure 3:
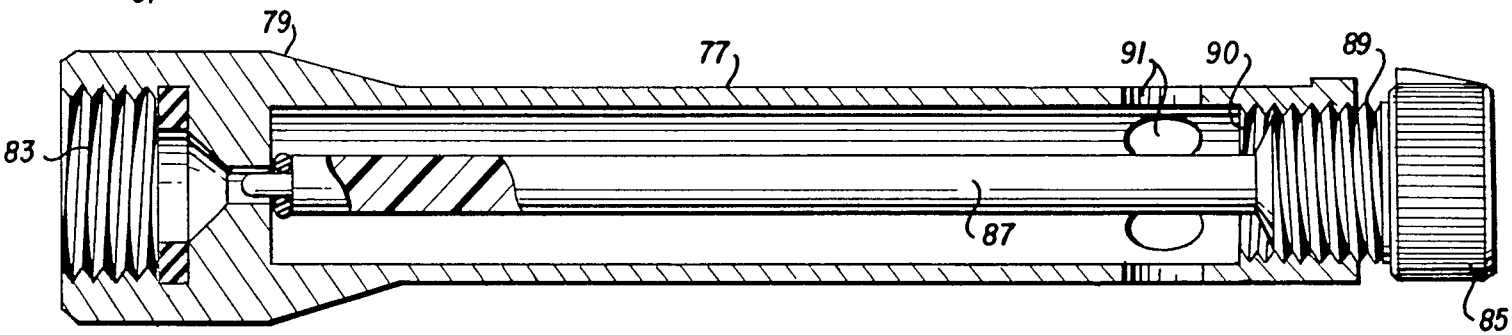
FIG. 3 is a cross-sectional view of a modification of the valve of FIG. 1.

Referring to FIG. 3, there is shown a drip valve similar to that of FIG. 1 which illustrates a variation on the construction of the valve. In this embodiment, tube 77 and collar 79 are all of one material (such as metal), while plug 85 and stem 87 are all of the same material (in this case, plastic). Again, internal threads 83 are adapted to match an outdoor faucet, while plug 85 has external threads 89 which mate with internal threads 90 at the distal end of tube 77. Tube 77 also includes water exit holes 91.

Figure 5:
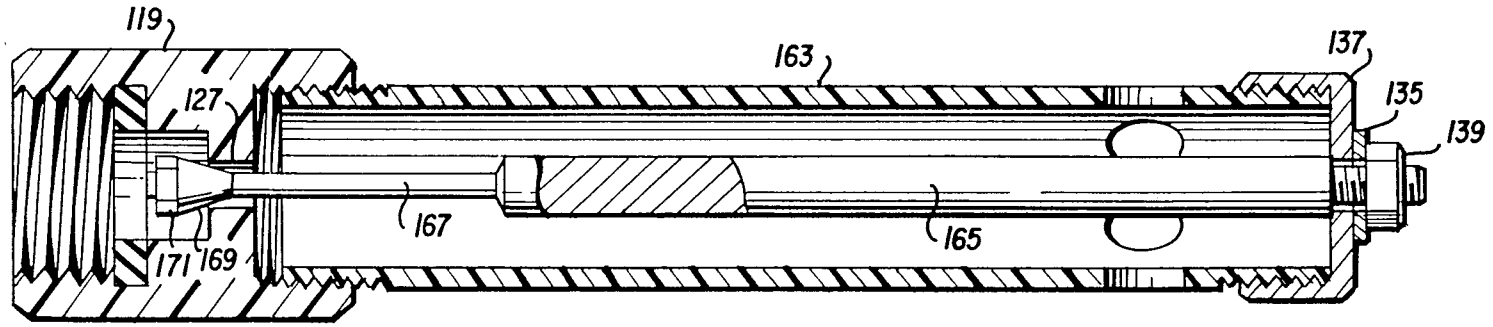
FIG. 5 is a cross-sectional view of a further modification of the valve of FIG. 1.
Figure 6:
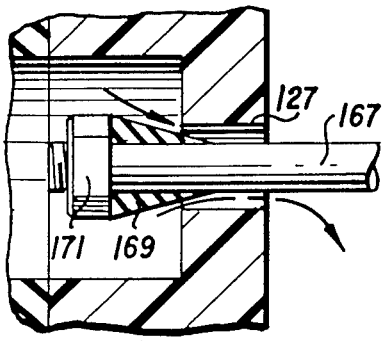
FIG. 6 is a partial cross-sectional view of the valve of FIG. 5.

Referring now to FIGS. 5 and 6, a further embodiment illustrates that the present invention is not limited to the use of O-rings. In this illustration, the roles of tube 163 and stem 165 are reversed. Tube 163 is of metal and stem 165 is of plastic. Cap 137 retains stem 135 in the same manner as described relative to FIG. 1. Additionally, collar 119 is of the same material and configuration as that shown in FIG. 1.

In the particular configuration shown in FIGS. 5 and 6, stem 165 includes reduced section 167 which passes through exit port 127 of collar 119. Compressible member 169 is mounted to the distal end of reduced section 167 by means such as nut 171.

In this configuration, plastic tube 163 shrinks faster than stem 165. This will force stem 165 in a direction which is to the left in FIGS. 5 and 6 so as to create an opening between compressible member 169 and exit port 127 so as to release water flow, as shown in FIG. 6.

It is to be understood that variations in the invention could be made. As an example, the differential length change between the stem and tube can be amplified by the use of two or more pairs, or sets, of concentric tubes, each consisting of a plastic stem and a metal tube so joined at both the distal and proximate ends of each tubular segment that their differential distances become additive. Such an arrangement could be used either to amplify the total resultant differential motion in a given overall length of the valve or used to shorten the overall length while attaining equivalent motion differential.

It will now be apparent that the present invention, using the differential coefficient of linear thermal expansion of metal and of plastic, provides a significant improvement over prior art valves due to its simple construction, which is removably attachable to an outside water faucet and is free from sliding seals and the use of special fluids.

It is to be understood that the above description and drawings are illustrative, only, since various modifications could be made without departing from the invention, the scope of which is to be limited only by the following claims.

I claim:

1. A self-actuating drip valve for attachment to a standard external water faucet to prevent freezing of water pipes exposed to outside temperatures comprising a collar adapted to be removably attachable to an external water faucet;

an exit port extending through said collar;

a hollow tube of a material having a first thermal linear coefficient of expansion secured to and extending outwardly of said collar;

a closure for mating with the distal end of said tube;

a stem within said tube extending between said closure and said port, said stem having a second thermal linear coefficient of expansion different from said tube; and compressible means at the distal end of said stem for releasably sealing said exit port whereby a predetermined drop in outside ambient temperature causes relative movement between said tube and said stem so as to move said compressible means away from said exit port so as to begin water flow between said compressible means and said exit port and through said tube, wherein said valve is able to self-regulate the water flow so as to balance the heat lost to the ambient by said faucet and said valve with available latent heat generated from the water flow.

2. The drip valve of claim 1 wherein said tube is of a metal material and said stem is of a plastic material.

3. The drip valve of claim 2 further comprising a pin at the distal end of said stem extending into said exit port and wherein said compressible means comprises an O-ring about said pin.

4. The drip valve of claim 1 wherein said tube is of a plastic material and said stem is of a metal material.

5. The drip valve of claim 1 wherein said tube and said collar comprise a unitary structure and said closure and stem are a unitary structure removably secured to the distal end of said tube.

6. The drip valve of claim 1 further comprising ports in said tube for permitting escape of water therethrough.

7. The drip valve of claim 1 further comprising means for adjusting said stem relative to said exit port.

8. The drip valve of claim 6 further comprising means for locking said stem in a predetermined position relative to said exit port.

9. A self-actuating drip valve for attachment to a standard external water faucet to prevent freezing of exposed water pipes comprising a collar adapted to be removably attachable to an external water faucet;

an exit port extending through said collar;

a hollow tube of a material having a first thermal linear coefficient of expansion secured to and extending outwardly of said collar;

a closure for mating with the distal end of said tube;

a stem within said tube extending between said closure and said port, said stem having a second thermal linear coefficient of expansion different from said tube; and compressible means adjacent said stem for releasably sealing said exit port with the distal end of said stem whereby a predetermined drop in ambient outside temperature causes relative movement between said tube and said stem so as to move said distal end of said stem away from said exit port so as to begin water flow between said compressible means and said exit port and through said tube, wherein said valve is able to self-regulate the water flow so as to balance the heat lost to the ambient by said faucet and said valve with available latent heat generated from the water flow.

* * * * *